United States Patent [19]

Leon

[11] 4,193,756

[45] Mar. 18, 1980

[54] SEAL ASSEMBLY AND METHOD FOR PROVIDING A SEAL IN A ROTARY KILN

[75] Inventor: F. Roland Leon, Los Angeles, Calif.

[73] Assignee: Tosco Corporation, Los Angeles, Calif.

[21] Appl. No.: 884,597

[22] Filed: Mar. 8, 1978

[51] Int. Cl.[2] ..... F27B 7/24

[52] U.S. Cl. ..... 432/3; 432/115; 34/242

[58] Field of Search ..... 432/3, 103, 115, 64, 432/242; 34/242

[56] References Cited

U.S. PATENT DOCUMENTS

| | | | |
|---|---|---|---|
| 1,550,591 | 8/1925 | Stone | 432/115 |
| 1,620,989 | 3/1927 | Agthe | 432/115 |
| 2,760,791 | 8/1956 | Neubauer et al. | 34/242 |
| 2,826,403 | 3/1958 | Moklebust | 432/115 |
| 3,193,266 | 7/1965 | Becker | 432/115 |
| 3,724,887 | 4/1973 | Roberts | 432/115 |
| 3,923,450 | 12/1975 | Inoue et al. | 432/115 |
| 3,940,239 | 2/1976 | Rossi et al. | 432/115 |

*Primary Examiner*—Henry C. Yuen

*Attorney, Agent, or Firm*—Poms, Smith, Lande & Rose

[57] ABSTRACT

A seal assembly and method for providing a contaminant-free, fluid-tight seal in a rotary kiln or similar rotating apparatus. A seal is provided between the rotating surfaces and the stationary surfaces of the kiln by providing an annular seal chamber defined by a rotating, outwardly-facing, U-shaped annular rim integral with the rotating surfaces of the rotary kiln and a stationary bellows chamber assembly integral with the stationary surfaces of the rotary kiln. An effective seal is maintained between the bellows chamber assembly and the annular rim by injecting a pressurized fluid into the bellows chamber so as to sufficiently bias its surfaces outwardly against the surfaces of the annular rim. The annular seal chamber is separated from the kiln chamber and its fluids and contaminants by an annular isolating chamber. The bellows chamber assembly prevents fluid communication between the seal chamber and the isolating chamber. The isolating chamber may communicate with the fluids of the kiln chamber via a one-way flap valve, and fluid is injected into the isolating chamber at a pressure sufficient to cause the injected fluid to flow from the isolating chamber, through the one-way valve and into the kiln chamber so as to prevent the flow of kiln fluids and contaminants into the isolating chamber.

16 Claims, 4 Drawing Figures

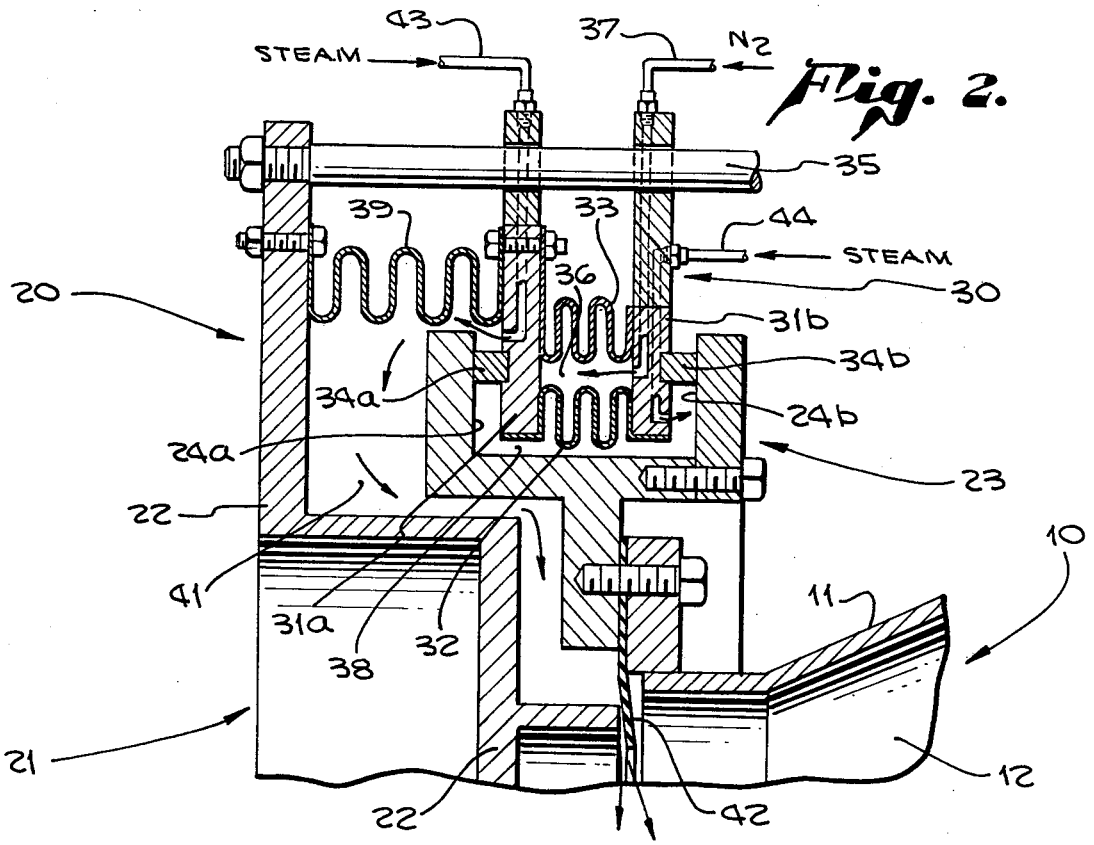
Fig. 2.
Fig. 3.
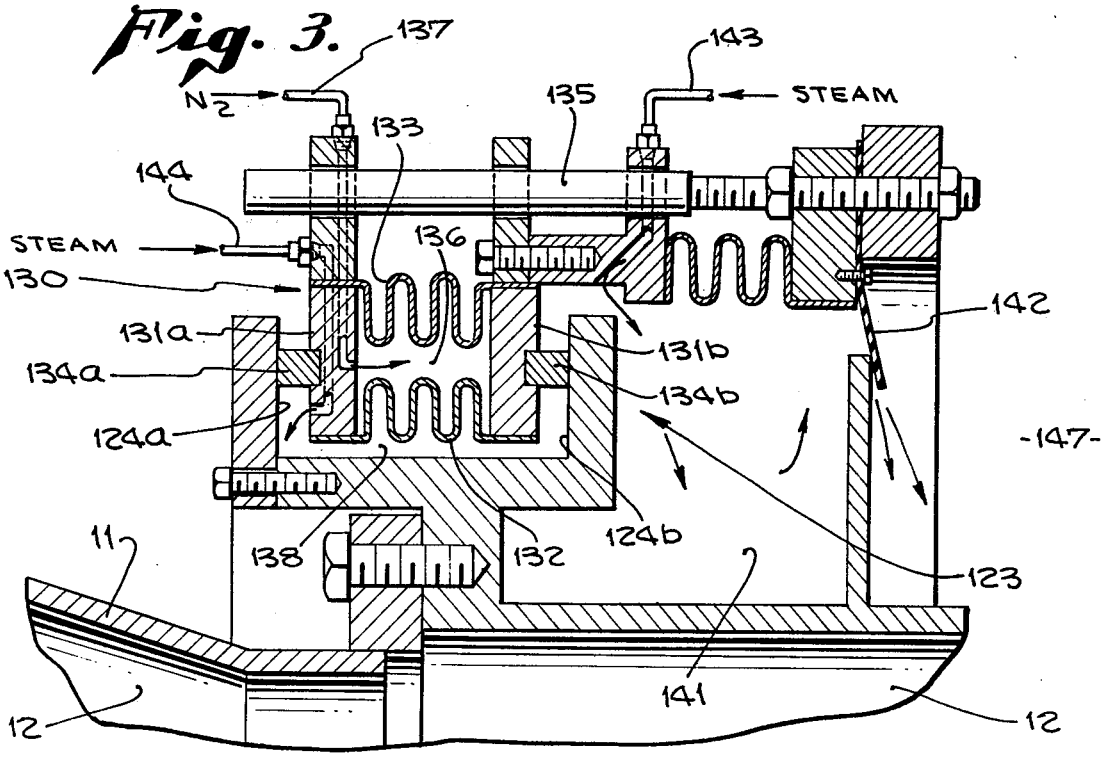

SEAL ASSEMBLY AND METHOD FOR PROVIDING A SEAL IN A ROTARY KILN

BACKGROUND OF THE INVENTION

1. Field of the Invention

This invention relates generally to seal assemblies, particularly to seal assemblies for rotating machinery, and more particularly to seal assemblies for pressurized rotary kilns.

2. Description of the Prior Art

The use of rotary kilns and the like has increased considerably over the past few years, particularly in the recovery of hydrocarbons by heating carbonaceous materials such as scrap rubber, coal, oil shale etc.. The efficiency of such rotary kilns can be substantially increased by their operation at a positive kiln chamber pressure.

While it has proved difficult to provide a satisfactory seal between the rotating surfaces and the stationary surfaces of the rotary kiln so as to maintain the positive internal pressure within the kiln, problems of seal fouling and leaking have also arisen as a result of hydrocarbon and particulate contamination caused by fluid communication between the kiln chamber and the sealing surfaces. It has also proven desirable to provide a seal assembly and method which is adjustable as to the tightness of the seal so as to provide the proper sealing depending on the particular pressure within the kiln chamber.

It is therefore the primary object of this invention to provide a rotary kiln having a new seal assembly, and to provide a method for providing an effective seal between the rotating surfaces and the stationary surfaces of the rotary kiln.

It is a further object of this invention to provide a means and method for sealing a pressurized rotary kiln so as to maintain the positive internal pressure of the kiln chamber.

It is an additional object to provide a sealing means and method which will prevent the fouling of the seals by contaminants produced in the kiln.

It is yet another object to provide a sealing means and method for providing an adjustable seal which can be adjusted to the internal kiln pressure.

These, and other objects to become apparent to those skilled in the art, are provided for by the invention which will be described hereinafter.

SUMMARY OF THE INVENTION

Briefly, the rotary kiln assembly of this invention comprises a first chamber defined by the rotating surfaces and the stationary surfaces of the rotary kiln, a first seal for restricting the kiln fluids from passing into the first chamber, a second chamber, and a second seal for preventing fluid communication between the first chamber and the second chamber and between the second chamber and the atmosphere.

In a preferred embodiment, a fluid is injected into the first chamber in proximity with the seal surfaces so as to prevent the accumulation of contaminants on the second seal, and the fluid is injected at a pressure sufficient to cause the fluid to pass from the first chamber, through the first seal, and into the chamber containing kiln fluids.

Also, in a preferred embodiment, a fluid is injected into the second chamber in proximity with the second seal so as to prevent the accumulation of contaminats on the second seal, and the fluid is injected at a pressure sufficient to maintain the pressure within the second chamber equal to or greater than the pressure within the first chamber. The second chamber is vented of the injected fluid in order to effect the removal of heat from the second chamber.

BRIEF DESCRIPTION OF THE DRAWINGS

FIG. 2 is a detailed, cross-sectional view of the portion of the rotary kiln shown within circle II in FIG. 1;

FIG. 3 is a detailed, cross-sectional view of the portion of the rotary kiln shown within circle III in FIG. 1.

DETAILED DESCRIPTION OF THE INVENTION

Figure 1:
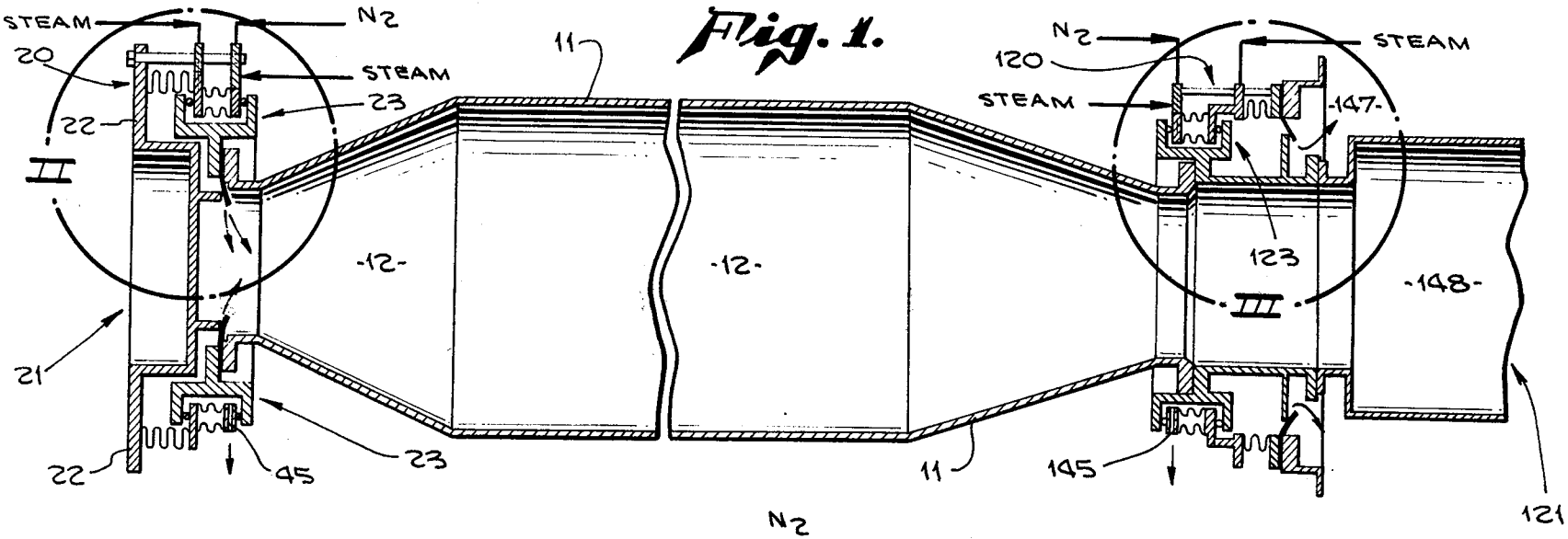
FIG. 1 is a cross-sectional, side view of a representative rotary kiln adapted to convert scrap rubber into useful products.

Referring now to the drawings and in particular FIG. 1, there is shown a rotary kiln 10 which may be part of a complete processing plant (not shown and whose general operation is otherwise well-known to those skilled in the art) for recovery of hydrocarbons from a carbonaceous material. The carbonaceous material, such as shredded rubber or the like, together with heat carrying solids are fed into the rotary kiln 10 through the feed end 21.

The feed end 21 includes feed end wall 22 which provides the structural support for the rotary kiln and provides the means for attaching the rotary kiln to its associated equipment. The feed end wall 22 is fixed and stationary, and does not rotate with the rotating surfaces of the rotary kiln. It is the stationary surfaces of the feed end wall 22 to which a fluid-tight seal must be made with the rotating surfaces of the rotary kiln. The feed end seal assembly is indicated generally at 20.

The rotary kiln 10 includes a rotating kiln body 11 and the attached and rotating, U-shaped, annular rim 23. It is the rotating, annular rim 23 that provides the sealing contact of the rotating kiln body 11 with the stationary portion of the rotary kiln 10.

On the right side of FIG. 1 is shown the discharge end 121, the discharge end seal assembly 120, and the rotating trommel 148. Also attached to the rotating kiln body 11 is a rotating, U-shaped, annular rim 123, which corresponds in function with annular rim 23. It is through the discharge end that the processed rubber material is withdrawn for further treatment, as well as where the various vapors are withdrawn from, as is all well known to those skilled in the art.

Referring now to FIG. 2, the means and method of providing a fluid-tight seal between the rotating surfaces and the stationary surfaces of the rotary kiln will be described. Integral and rotating with the rotating kiln body 11 is the annular rim 23 which circumvents the feed end 21. Annular rim 23 has a substantially U-shaped cross-section having two opposing rim surfaces **24*a* and 24*b*** which provide the necessary sealing contact for the seal.

Positioned within the outwardly-facing U-shaped section defined by the annular rim 23 and its rim surfaces 24 is a bellows chamber assembly 30. The bellows chamber assembly 30 comprises two end sealing members 31*a* and 31*b* which circumvent the annular rim 23, two concentric bellows 32 and 33, and sealing rings 34*a* and 34*b*. Bellows 32 and 33 circumvent the annular rim 23 and are fluid-tightly attached to the end sealing members 31. The bellows are made of a material which can withstand high temperatures and moisture, and which is also relatively flexible so as to allow the end sealing members 31 to move together or apart as the bellows themselves expand or contract. The sealing rings 34 are fluid-tightly attached to the exterior surfaces of the end sealing members 31 and are caused to sealingly contact the inside surface of the opposing rim surfaces 24. The sealing rings 34 are made of a material also able to withstand high temperature and moisture. It is the contact between the sealing rings 34 and the rim surfaces 24 that provides the seal between the rotating portion and the stationary portion of the rotary kiln.

The bellows chamber assembly 30 is supported from above by a shaft 35 passing through openings in end sealing members 31 so as to maintain the bellows assembly in its proper concentric configuration. While the bellows assembly 30 is restrained in the vertical direction by shaft 35, the shaft and the openings in the end sealing members are constructed so as to allow the sealing members 31 to move laterally.

The bellows chamber 32 and 33 and the inside surfaces of the end sealing members 31 to define an annular bellows chamber 36. A means for pressurizing the bellows chamber 36 is provided which will expand bellows 32 and 33 and thereby bias sealing members 31 outwardly so as to result in a fluid-tight seal between the sealing rings 34 and the rim surfaces 24. In the preferred embodiment, the pressurizing means includes a means 37 for injecting a fluid into the bellows chamber 36 so as to maintain the bellows chamber 36 at the desired pressure. In the preferred embodiment shown in FIG. 2, the injected fluid is the inert gas, nitrogen.

The inner bellows 32, the outer surfaces of end sealing members 31, and the inner surfaces of annular rim 23 define a seal chamber 38. This chamber also circumvents the annular rim 23 and serves as the primary seal between the rotary kiln chamber 12 and the atmosphere.

There is next provided an isolating chamber 41 which is substantially defined by the inner surface of feed wall 22, flexible bellows 39, and the outer surface of annular rim 23. Chamber 41 serves to isolate seal chamber 38 from the rotary kiln chamber 12 and its kiln fluids. Because the rotary kiln chamber will have produced within it many contaminants such as particulate matter, and hydrocarbon vapors, among other things, it is desirable to restrict their passage into the isolating chamber and their contact with the seal surfaces and seal rings 34. Because even the particulate matter in the kiln tends to flow, all the contaminants within the kiln are contained in what will be called "kiln fluids" hereinafter.

In order to prevent the flow of kiln fluids from the kiln chamber 12 into the isolating chamber 41, a means 42 for restricting the flow of kiln fluids from the kiln chamber 12 into the isolating chamber 41 is provided. In the preferred embodiment, this means takes the form of a one-way valve or flap 42 which is connected to the rotating annular rim 23 and makes brushing sealing contact with an edge of the stationary feed end wall 22.

Because the kiln chamber will normally be operated at a positive pressure of several psig, it is also preferred to maintain the isolating chamber 41 at a pressure sufficient to cause the flow of fluid from the isolating chamber 41, through the valve passage, and into the kiln chamber 12. In the preferred embodiment a fluid such as steam, is injected into the isolating chamber 41 via fluid injection means 43. The steam is injected into the isolating chamber 41 in proximity with the seal surfaces and seal ring 34*a* so as to prevent the buildup of whatever contaminants or kiln fluid does enter the isolating chamber 41. The steam is injected at a pressure so as to maintain the pressure within the isolating chamber above the pressure within the kiln chamber so that the steam continually passes into the kiln chamber 12 to thereby prevent kiln fluids from entering the isolating chamber 41.

Returning now to a discussion of the seal chamber 38, this chamber is also provided with a means for pressurizing the seal chamber. The seal chamber 38 is preferrably maintained at a pressure equal to or greater than the pressure within the isolating chamber 41. This would insure that should the seal ring 34*a* begin to leak, the flow of fluid would be from seal chamber 38 into the isolating chamber 41, thereby maintaining the pressure within the kiln chamber 12. In the preferred embodiment, the means is a fluid injection means 44 for injecting a fluid, such as saturated steam, into the seal chamber 38. Again it is preferred that the saturated steam be injected in proximity with the seal rings 34 and the surface of the sealing members 31 so as to prevent the buildup of contaminants which would affect the fluid-tight seal. In addition, the seal chamber 38 is provided with a fluid venting means 45 which allows the removal of fluid from the seal chamber 38. While it is still intended that the seal chamber 38 be maintained at a pressure equal to or greater than the pressure within the isolating chamber, it is desirable to vent the seal chamber in order to effect a removal of heat transferred to the seal chamber by the heat generated within the kiln chamber.

Referring now to FIG. 3 which shows the discharge end 121 of the rotary kiln 10 and in particular the discharge end seal assembly 120. The discharge end seal assembly functions in a manner analogous to the feed end seal assembly 20. An attempt has been made to number the parts in the discharge end which are analogous to parts in the feed end by increasing their number by 100.

The discharge end 121 is provided with a rotating, outwardly-facing, substantially U-shaped annular rim 123 integrally attached to the rotating kiln body 11. There is also provided a stationary bellows chamber assembly 130 comprising a bellows 132 and bellows 133, end sealing members 131*a* and 132*b*, and sealing rings 134*a* and 134*b*. Again, the bellows chamber assembly defines a bellows chamber 136 and is supported from above by shaft 135 which allows the bellows 132, and 133, and the end sealing members 131*a* and 131*b* to freely move laterally to allow the bellows assembly to expand or contract.

Fluid injection means 137 is provided to inject nitrogen into the bellows chamber 136 to maintain the pressure within the bellows chamber at a pressure sufficient to outwardly bias the walls of the end sealing members 131*a* and 131*b* to provide an effective fluid-tight seal with the opposing surfaces 124 of the annular rim 123.

There is also provided an isolating chamber 141 which serves to isolate the seal chamber 138 from the vapor accumulator chamber 147. The vapor accumulator chamber 147 is disposed adjacent to the trommel and serves to collect the gaseous kiln fluids for later treatment or disposal. Because these particular kiln fluids may also contaminate the sealing rings and seal assembly, the isolating chamber 141 is provided to separate the seal chamber 138 from the vapor accumulator chamber 147. In view of the fact that the vapor accumulator chamber 147 contains kiln fluids it is considered part of the kiln chamber for purposes of this invention.

The isolating chamber 141 is also provided with a means for restricting the flow of kiln fluids into the chamber 147. In the preferred embodiment, this takes the form of a one-way valve or flap 142 which is attached to a stationary portion of the vapor accumulator chamber 147 and which circumvents the rotary kiln and makes brushing sealing contact with a rotating wall of the isolating chamber 141. The restricting means 142 will allow fluid to pass from the isolating chamber 141 into the vapor accumulator chamber 147, but not in the opposite direction. The isolating chamber 141 is provided with a means for maintaining the pressure within the isolating chamber so as to be greater than the pressure within the vapor accumulator chamber 147. In the preferred embodiment this means if provided for by a fluid injection means 143 which injects a fluid, preferably steam, at a pressure sufficient to cause the injected fluid to continually flow from the isolating chamber 141, through the restricting means 142 and into the vapor accumulator chamber 147 to insure that no kiln fluids enter the isolating chamber 141. It is preferred that the fluid be injected in proximity to the sealing ring 134 and end sealing member **131*b*** to prevent the buildup of contaminants which may affect the fluid-tight seal.

As in the feed end seal assembly, the seal chamber 138 is provided with a means for maintaining its pressure equal to or greater than the pressure within isolating chamber 141. In the preferred embodiment, this means is provided for by a fluid injection means 144 for injecting a fluid, preferably steam, into the seal chamber 138 at a pressure sufficient to provide the seal chamber with the desired pressure. It is also preferred that the fluid be injected in proximity with the sealing ring **134*a* and the inner rim surface of the annular rim 123 to prevent the buildup of contaminants which may affect the fluid-tight seal. Also, in the preferred embodiment, the seal chamber 138** is provided with a means for venting the sealing chamber of the injected fluid. The venting of the sealing chamber will allow for the removal of heat from the sealing chamber which results from heat generated within the rotary kiln.

Figure 4:
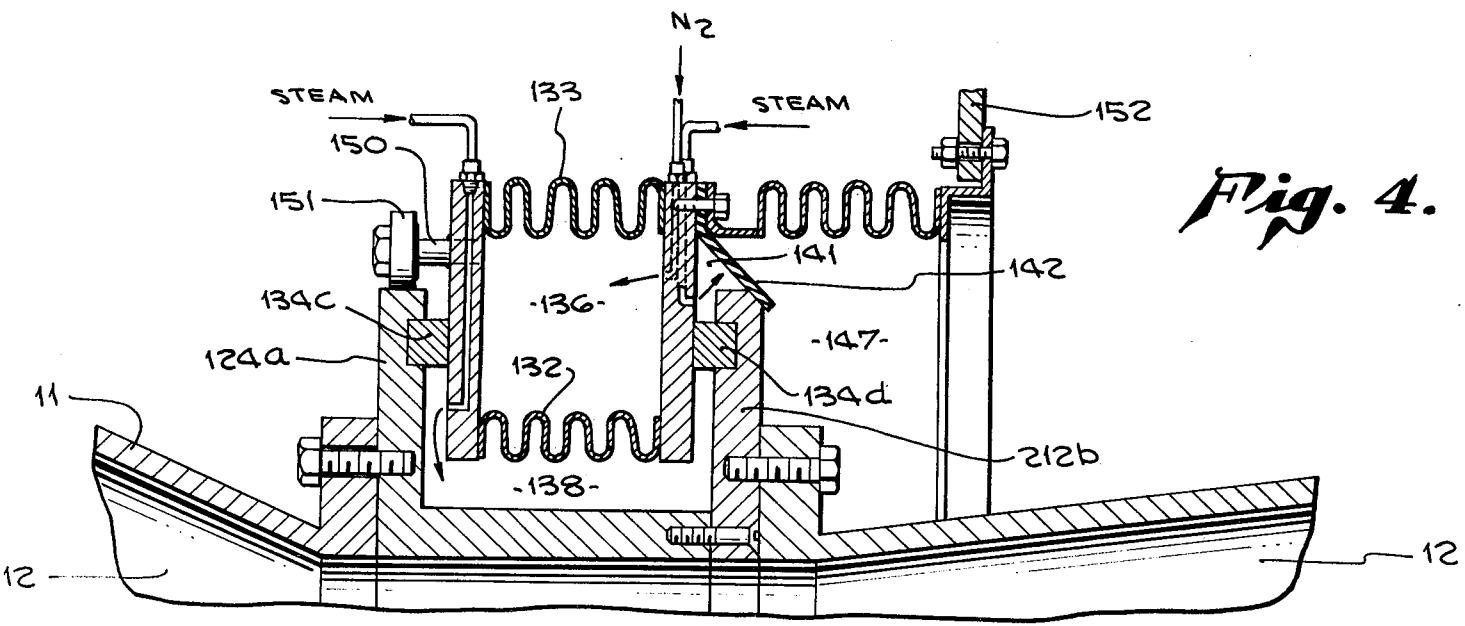
FIG. 4 is a detailed, cross-sectional view of an alternative embodiment of the portion of the rotary kiln shown in FIG. 3.

Referring now to FIG. 4, there is shown an alternative embodiment to the structure shown in FIG. 3. The seal assembly of FIG. 4 is provided with an axle 150 attached to the sealing member, and the axle has a roller 151 on its end so as to roll on top of the rim surface 124 as the rotary kiln rotates. The axle 150 and roller 151 support one end of the bellows chamber assembly in concentric alignment with the rotating annular rim. The other end of the bellows assembly is supported by support 152, of which only a part is shown.

Also sealing rings **134*c* and 134*d* are attached to the rotating opposing rim surfaces and provide a fluid-tight seal as they rotate in sealing contact with the other surface of the sealing members. In addition, the isolating chamber 141** is made smaller by positioning the one-way valve into contact with the top of the opposing rim surface.

A major advantage of the sealing assembly of this invention is that by using a bellows chamber assembly, the force required by the sealing members to exert the proper pressure against the sealing rings and the opposing rim surfaces can be easily adjusted by opening valve 26 and injecting or releasing fluid so that the bellows chamber pressure meets the needs necessitated by the pressure within the kiln chamber. Because of the desired relationships between the kiln chamber pressure, the isolating chamber pressure, and the seal chamber pressure, the higher the kiln chamber pressure is, the higher the desired seal chamber pressure will be.

Because one of the sealing rings provides the seal between the high pressure seal chamber and the atmosphere, it is imperative that the seal not leak, and therefore the greater the pressure within the seal chamber the greater the force needed by the sealing members to exert against the sealing ring and opposing rim surfaces. This force is increased or decreased, as desired, by increasing or decreasing the pressure within the bellows chambers.

Also, because pressures are easily and quickly measured, a constant monitoring of the pressure within the bellows chamber can be maintained, thereby allowing the operators of the rotary kiln to know exactly how tight the seals are. Furthermore, because the force of the seals are provided for by fluid pressure, there is no concern with springs or other conventional biasing means wearing out.

Obviously, many modifications and variations of the present invention are possible in light of the above teachings. It is, therefore, to be understood that within the scope of the appended claims, the invention can be practiced otherwise than as specifically described.

I claim:

1. A seal assembly adapted for use with a rotary kiln, and adapted to provide a fluid-tight seal between the stationary members and the rotating members of the rotary kiln, comprising:

a rotating, outwardly-facing, substantially U-shaped annular rim integral with the rotating members of the rotary kiln and having two opposing rim surfaces; and a stationary annular bellows chamber integral with the stationary members of the rotary kiln and disposed between the two opposing rim surfaces, and including means for providing a fluid-tight seal between the bellows chamber and the opposing rim surfaces so as to define a seal chamber.

2. A rotary kiln having a kiln chamber, rotating members, stationary members, and a seal assembly which provides a fluid-tight seal between the rotating members and the stationary members, comprising:

a first chamber defined in part by rotating members and in part by stationary members, first seal means disposed between a rotating member and a stationary member for preventing fluid communication to the first chamber from the kiln chamber;

a second chamber defined in part by rotating members and by stationary members and disposed so that the first chamber prevents direct fluid communication between the second chamber and the kiln chamber;

second seal means disposed between a rotating member and a stationary member for preventing fluid communication between the first chamber and the second chamber; and third seal means disposed between a rotating member and a stationary member for preventing fluid communication between the second chamber and the atmosphere;

so that should one of the seal means malfunction, the first chamber will not directly communicate with the atmosphere.

3. In a rotary kiln having a kiln chamber defined by rotating members and by stationary members, and being operated at a positive pressure, the method of providing a fluid-tight seal between the rotating members and the stationary members so as to prevent a loss of pressure from the kiln chamber, comprising:

providing a first chamber which communicates with said kiln chamber via a first seal which only allows fluid flow from the first chamber to the kiln chamber;

injecting a fluid into said first chamber at a pressure sufficient to cause the injected fluid to pass through said first seal so as to prevent kiln fluids from entering the first chamber;

providing a second chamber separated from said first chamber by a second seal, and disposed such that said second chamber prevents direct contact between the second seal and the atmosphere, thereby preventing the first chamber from directly communicating with the atmosphere in the event of the second seal malfunctioning; and maintaining said second chamber at a pressure equal to or greater than the pressure within the first chamber.

4. In rotary kiln having a kiln chamber defined by rotating members and by stationary members, and said kiln chamber being operated at a positive pressure, the method of providing a fluid-tight seal between the rotating members and the stationary members, comprising:

providing a first annular chamber defined in part by a rotating member and in part by a stationary member;

providing said first annular chamber with two seals each disposed at the two junctions of the rotating member and the stationary member so as to complete the definition of said first annular chamber, the first of said two seals restricting the flow of fluid from said kiln chamber into said first chamber;

continuously injecting a fluid into said first chamber so that the fluid pressure within said chamber is sufficient to cause said fluid to flow from said first chamber through said first seal and into said kiln chamber;

providing a second annular chamber defined by a stationary member, a rotating member, the second of said two fluid seals, and a third seal, said second seal disposed between the rotating member and the stationary member and preventing fluid communication between the first chamber and the second chamber, and said third seal disposed between said rotating member and said stationary member and preventing fluid communication between the second chamber and the atmosphere;

injecting a fluid into said second chamber so that the second chamber is maintained at a pressure equal to or greater than the pressure within the first chamber so as to prevent fluid flow from the first chamber into the second chamber; and venting said injected fluid from said second chamber.

5. In a rotary kiln having a kiln chamber defined by rotating members and by stationary members and being operated at a positive pressure, the method of providing a fluid tight seal between the rotating members and the stationary members comprising:

providing an annular isolating chamber which directly communicates with the kiln chamber via passage means for only allowing fluid flow from the isolating chamber into the kiln chamber;

injecting a fluid into said isolating chamber at a pressure sufficiently greater than the pressure within the kiln chamber so that the injected fluid will pass through said passage means from the isolating chamber into the kiln chamber to prevent kiln fluids from entering the isolating chamber;

providing an annular seal chamber defined by a rotating, outwardly-facing, U-shaped annular rim, integral with said kiln, said rim having two opposing rim surfaces, and further defined by a stationary annular bellows chamber;

separating the isolating chamber and sealing chamber with a seal disposed between the bellows chamber and one of said opposing rim surfaces; and injecting a fluid into said seal chamber so that its pressure is equal to or greater than the pressure within said isolating chamber so as to prevent fluid flow from the isolating chamber to the seal chamber, and venting said injecting fluid from said seal chamber so as to withdraw heat from said seal chamber.

6. The method defined in claim 5 wherein the fluid injected into the isolating chamber and the seal chamber is steam.

7. A rotary kiln having rotating members, stationary members, a kiln chamber, and a seal assembly for providing a fluid-tight seal between the rotating members and the stationary members, comprising:

a rotating kiln having an integral, rotating, outwardly-facing, U-shaped, annular rim providing two opposing rim surfaces;

a stationary bellows assembly comprising two concentric expandable bellows sealingly attached to two opposed end sealing members so as to define a fluid-tight annular bellows chamber; said bellows assembly being disposed between the two opposing rim surfaces of the annular rim so as to define a seal chamber between the inner concentric bellow and the inside of the U-shaped rim;

sealing means for providing a fluid-tight seal between the rotating opposing rim surfaces and the stationary members, wherein the sealing means prevents fluid communication between the interior of the seal chamber and the exterior of the seal chamber; and pressuring means for maintaining the bellows chamber at a pressure which sufficiently biases the end sealing members outwardly so as to maintain an effective seal between the end sealing members, the sealing means, and the rim surfaces.

8. The rotary kiln defined in claim 7 further including:

an isolating chamber disposed to prevent direct fluid communication between the seal chamber and the kiln chamber, wherein said isolating chamber is provided with a passage means for preventing kiln fluids from entering said isolating chamber and allowing fluid to flow from the isolating chamber to the kiln chamber, and wherein said sealing means includes means for preventing fluid communication between the seal chamber and the isolating chamber.

9. The rotary kiln defined in claim 2 further including an injection means for injecting a fluid into the isolating chamber in proximity with the sealing means to prevent the buildup of contaminants, said injection means also providing for injecting said fluid at a pressure sufficiently greater than the kiln chamber pressure so that said fluid will flow through the passage means into the kiln chamber.

10. The rotary kiln defined in claim 9 wherein said pressuring means includes a seal chamber pressure means for maintaining the pressure within the seal chamber at a pressure equal to or greater than the pressure within the isolating chamber.

11. The rotary kiln defined in claim 10 wherein said seal chamber pressure means includes means for injecting a fluid into said seal chamber in proximity with the sealing means to prevent the buildup of contaminants and means for venting said seal chamber of said injected fluid.

12. The rotary kiln defined in claim 1 wherein said pressuring means includes means for adjusting the pressure within the bellows chamber so as to be able to increase or decrease the pressure within the bellows chamber as the kiln chamber pressure increases or decreases, respectively.

13. A rotary kiln having a kiln chamber, rotating members, stationary members, and a seal assembly which provides a fluid-tight seal between the rotating members and the stationary members, comprising:

a first chamber defined in part by rotating members and in part by stationary members;

first seal means for restricting the kiln fluids from passing from the kiln chamber into the first chamber, and for allowing fluid to pass from the first chamber into the kiln chamber;

a second chamber defined in part by rotating members and in part by stationary members, and being disposed so that the first chamber prevents direct fluid communication between the second chamber and the kiln chamber; and second seal means for providing a fluid-tight seal between the rotating members and the stationary members of the rotary kiln and for preventing fluid communication between the first chamber and the second chamber and between the second chamber and the atmosphere.

14. The rotary kiln defined in claim 13 further including:

first means for maintaining said kiln chamber at a pressure above atmospheric pressure; and second means for maintaining the pressure in said first chamber at a first chamber pressure greater than said kiln chamber pressure.

15. The rotary kiln defined in claim 14 wherein:

said second chamber includes a third means for maintaining the chamber pressure in said second chamber at a second pressure equal to or greater than said first chamber pressure.

16. The rotary kiln defined in claim 15 wherein:

said second means includes means for injecting a fluid into said first chamber at a pressure sufficient to cause the injected fluid to pass through said first seal means and into said kiln chamber so as to prevent kiln fluids from entering the first chamber; and said third means includes means for injecting a fluid into said second chamber and means for venting said second chamber of said injected fluid.

* * * * *